United States Patent [19]

Penno

[11] Patent Number: 4,928,416

[45] Date of Patent: May 29, 1990

[54] AN ACCESSORY FOR ATTACHMENT OF PROMOTIONAL CHARACTERS TO PENS, KEY HOLDERS AND THE LIKE

[76] Inventor: Gianluca Penno, Strada Maiole, 3/8 Moncalieri (TO), Italy

[21] Appl. No.: 226,203

[22] Filed: Jul. 29, 1988

[30] Foreign Application Priority Data

Jul. 30, 1987 [IT] Italy ..... 67664 A/87

[51] Int. Cl.[5] ..... G09F 7/02

[52] U.S. Cl. ..... 40/618; 40/334; 40/330; 40/620

[58] Field of Search ..... 40/330, 334, 335, 618, 40/620, 622, 625, 634; 401/52, 195, 292

[56] References Cited

U.S. PATENT DOCUMENTS

| | | | |
|---|---|---|---|
| 405,102 | 6/1889 | Kraus | 40/334 |
| 1,832,318 | 11/1931 | Myers | 40/334 |
| 2,342,237 | 2/1944 | Barbieri | 40/618 |
| 3,229,398 | 1/1966 | Kopatich | 40/620 |
| 3,270,452 | 9/1966 | D'Elia et al. | 40/620 |

*Primary Examiner*—Richard J. Apley
*Assistant Examiner*—D. F. Crosby
*Attorney, Agent, or Firm*—Oblon, Spivak, McClelland, Maier & Neustadt

[57] ABSTRACT

An accessory for attaching characters (letters or symbols) to pens, key holders and the like. Each individual character has an aperture and a toothed member. The characters are assembled by inserting an elongated body through the apertures. The toothed member mates with a slot in the elongated body to orient the characters perpendicular to the elongated body. Complementary interlocking teeth in the slot securely fasten the characters to the body and insure proper spacing between the characters.

9 Claims, 2 Drawing Sheets

AN ACCESSORY FOR ATTACHMENT OF PROMOTIONAL CHARACTERS TO PENS, KEY HOLDERS AND THE LIKE

BACKGROUND OF THE INVENTION

Field of the Invention

The present invention refers to an accessory to be used for publicity and promotion, obtained from linking three dimensional symbols, in particular letters or numbers, with a cylindrical or generally prismatic body.

Discussion of the Background

For promotional or publicity activities the need is noted to affix in a clear way letters or various symbols on articles like pens, key holders, or similar objects.

Such letters or symbols are normally realized by way of typographic press, or by incision, or in relief on the surfaces of the abovesaid articles.

The above cited systems, though economical and easy to produce, do not always achieve their aim of displaying in a satisfactory way the letters or symbols fixed to the articles.

SUMMARY OF THE INVENTION

The present invention is an accessory to be used in promotional or publicity fields, which advantageously displays symbols or trademarks placed on the same, and which may be employed as a writing instrument, key holder, or similar object.

One aim of the present invention is to create an accessory which can be used for publicity or promotional ends, characterised by the fact that it is formed by linking various three dimensional object, in particular letters or numbers obtained by casting, with a cylindrical or generally prismatic body, on which they are forceably inserted.

A further aim of the present invention is in terms of producing in a simple and economic way an accessory with a publicity of promotional aim; whose cylindrical or prismatic part constitutes by itself, for example a writing instrument or a key holder or alternatively can be adapted to link on an end with a writing instrument or with the end part of a key holder or other object which can be used for publicity or promotional ends.

Further characteristics and advantages from the invention here described will be evident from the detailed description as follows, supplied with descriptive titles and therefore not limiting; making reference to the single attached table of drawings where:

DESCRIPTION OF THE PREFERRED EMBODIMENTS

Figure 1:
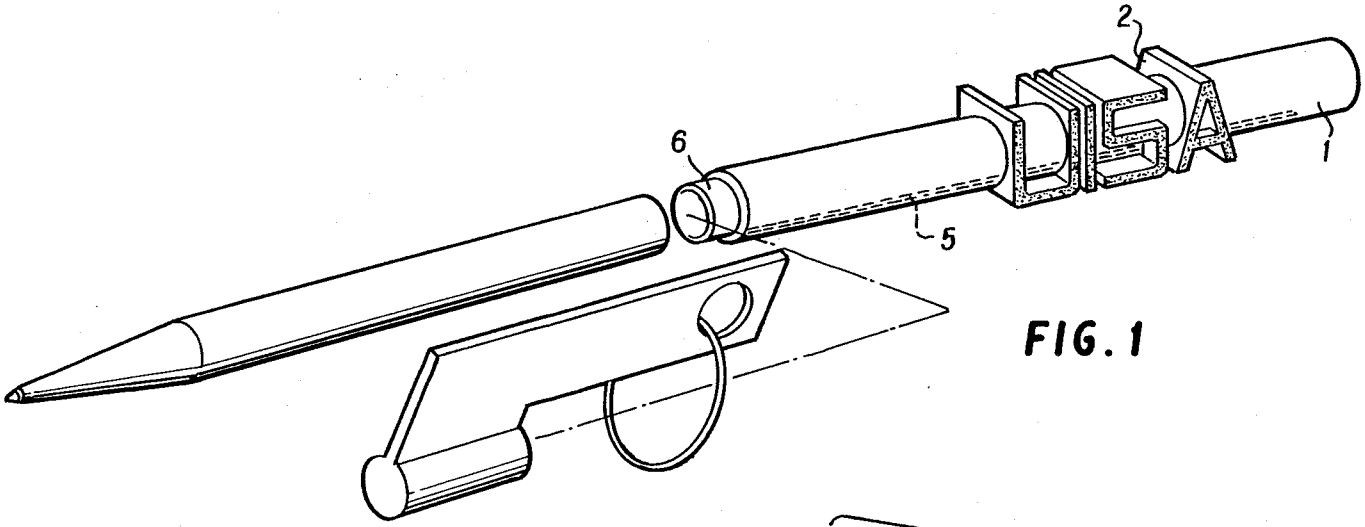
FIG. 1 is the prospective, blow-up and entire view of the accessory realized with regard to the present invention.
Figure 2:
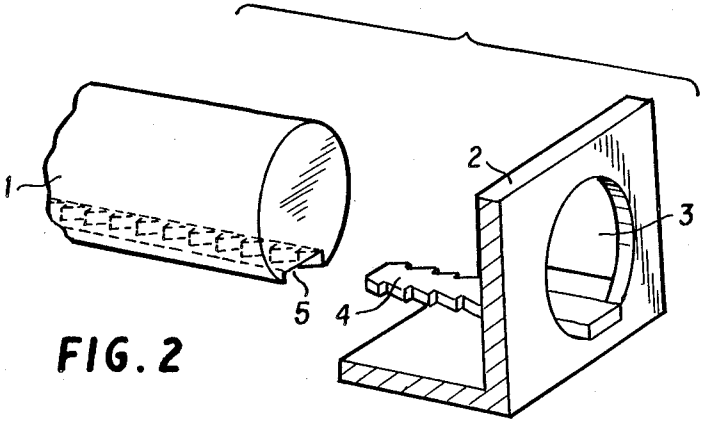
FIG. 2 is a partial prospective view enlarged and blow-up from FIG. 1.
Figure 3:
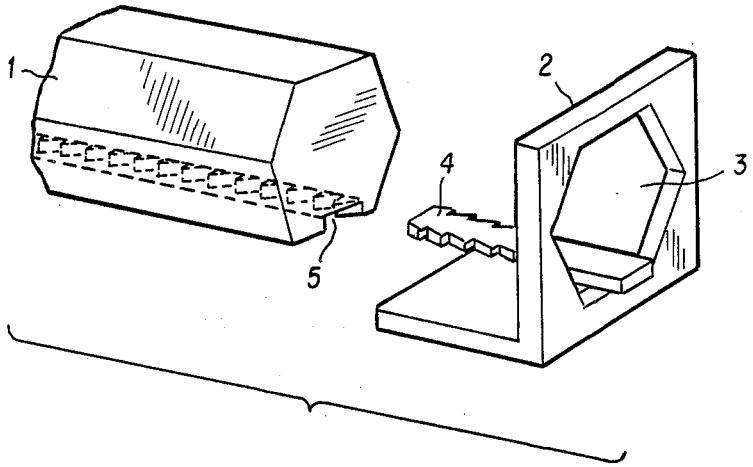

The accessory which may be used for publicity or promotional ends as is illustrated in FIG. 1, is formed by a body as in cylinder 1, which can also be made in a generally prismatic way, bearing a series of symbols, shown by FIG. 2 in the example given, made of plastic material, obtained by casting.

The abovementioned letters are inserted perpendicular on the elongated body with respect to the axis of the same and are arranged with a small amount of space between them.

As illustrated in FIG. 2, the above mentioned letters indicated by 2 are inserted and blocked on the above mentioned elongated body 1 by way of complementary coupling means, present in both the letters and in the elongated body.

More specifically the above mentioned three dimensional letters present laterally an aperture 3, in diameter slightly greater with respect to the elongated body, and on the base a coupling means formed by a tooth 4, laterally incised and slightly projecting from the base of the letter.

In its turn, the elongated body, this too in plastic material, externally presents and opposite above mentioned letter tooth, a longitudinal channel with toothed borders constituting the complementary means of coupling.

Finally, in the illustrated example, the elongated body has a tapered extremity 6, to allow insertion of a manual writing instrument or key holder.

In accordance with another embodiment, the elongated body can be made so as to form itself a writing instrument or whatever other object with a publicity or promotional aim.

From what has been explained and illustrated above, it will be clear that the accessory above permits one to make a promotional or publicity object, when the writings present in the same are shown in the best way: being formed from symbols or three dimensional letters, forceably put together with a cylindrical or generally prismatic body using a complementary means of coupling: where there is blocking of the said letters or symbols, guaranteed by the toothed profile of the coupling mechanism, and where the abovesaid letters or symbols are slightly separated thanks to the means of coupling, which act so as to correctly distance the letters one from the other.

Further it is also clear that the link between the letter and the elongated body can be effected by way of whatever complementary connection and can permit the formation of whatever graphic symbolism on the body in addition to cylindrical, of whatever generally prismatic shape.

Considering the procedure principally describing the invention under discussion its practical production may vary widely, without, at the same time, going beyond the limits of the present invention, as protected by the following claims.

What is claimed as new and desired to be secured by Letters Patent of the United States is:

1. An accessory to be attached to pens, key holders and similar products, for publicity and promotional ends, comprising:

an elongated body;

three-dimensional symbols, said symbols containing an aperture through which said body is inserted, and said aperture being of the same shape and of a size slightly greater than the cross-section of said body; and coupling means on said symbols to fasten said symbols to said body, said coupling means including a toothed member projecting from said symbol.

2. Accessory of claim 1 characterized by the fact that said body (1) is cylindrical in shape.

3. Accessory of claim 1 characterized by the fact that said body (1) has a generally prismatic form.

4. Accessory of claim 1 characterized by the fact that said three-dimensional symbols are formed by letters and numbers.

5. Accessory of claim 1, characterized by the fact that said body (1) contains a complementary coupling means including a longitudinal channel (5) adapted to be fastened with said toothed member of said three-dimensional symbols (2).

6. Accessory to claim 1, characterized by the fact that said toothed member (4) is rectangular in shape with a plurality of teeth symmetrically placed on two longitudinal edges.

7. Accessory of claim 5, characterized by the fact that said longitudinal channel (5) has a plurality of teeth symmetrically placed on two longitudinal edges.

8. Accessory of claim 1, characterized by the fact that said elongated body (1) has a tapered extremity (6) to allow insertion of a manual writing instrument or similar objects with publicity or promotional aim.

9. Accessory of claim 1 characterized by the fact that the said symbols (2) are forceably inserted into said body (1) and securely fastened to said body by the joining of said toothed member (4) and complementary coupling means (5) on said body, and said symbols are held perpendicular to said body (1) and separated from one another by means of said toothed member (4).

* * * * *